US008105186B1

(12) United States Patent
Futtere

(10) Patent No.: US 8,105,186 B1
(45) Date of Patent: Jan. 31, 2012

(54) REVERSIBLE CUTTING APPARATUS AND METHOD

(76) Inventor: Matthew Futtere, Liberty Hill, TX (US)

( * ) Notice: Subject to any disclaimer, the term of this patent is extended or adjusted under 35 U.S.C. 154(b) by 481 days.

(21) Appl. No.: 12/288,477

(22) Filed: Oct. 21, 2008

(51) Int. Cl.
*F42B 6/08* (2006.01)

(52) U.S. Cl. ..... 473/583; 473/584

(58) Field of Classification Search ..... 473/583, 473/584; 30/303
See application file for complete search history.

(56) References Cited

U.S. PATENT DOCUMENTS

| | | | | |
|---|---|---|---|---|
| 4,029,319 | A * | 6/1977 | Christen | 473/584 |
| 4,928,969 | A * | 5/1990 | Nagatori | 473/584 |
| 5,172,916 | A * | 12/1992 | Puckett | 473/583 |
| 5,636,845 | A * | 6/1997 | Newnam | 473/583 |
| 7,311,622 | B1 | 12/2007 | Futtere | |
| 7,393,295 | B1 | 7/2008 | Futtere | |

* cited by examiner

*Primary Examiner* — John Ricci
(74) *Attorney, Agent, or Firm* — J. Nevin Shaffer, Jr.

(57) ABSTRACT

A reversible cutting apparatus includes a first cutting blade for connection with an arrow shaft such that the first cutting blade extends outwardly from the arrow shaft. The first cutting blade includes an upper, outer surface and a lower, inner surface. A first cutting edge is provided on the upper, outer surface of the first cutting blade and a second cutting edge is provided on the lower, inner surface of the first cutting blade. In another embodiment, in an arrow with a shaft, a reversible cutting apparatus includes a first cutting blade with a connection receiver space for connection with an arrow shaft such that the first cutting blade extends outwardly from the arrow shaft and where the first cutting blade includes a first cutting edge and a second cutting edge. A second cutting blade is provided with a connection receiver space for connection with the arrow shaft such that the second cutting blade extends outwardly from the arrow shaft and where the second cutting blade extends outwardly from the arrow shaft but on a separate plane than the first cutting blade such that the first cutting blade and the second cutting blade are offset from each other when connected with the arrow shaft.

20 Claims, 2 Drawing Sheets

REVERSIBLE CUTTING APPARATUS AND METHOD

FIELD OF THE INVENTION

This invention relates to a reversible cutting apparatus and method. In particular, in accordance with one embodiment, the invention relates, to a reversible cutting apparatus including a first cutting blade for connection with an arrow shaft such that the first cutting blade extends outwardly from the arrow shaft. The first cutting blade includes an upper, outer surface and a lower, inner surface. A first cutting edge is provided on the upper, outer surface of the first cutting blade and a second cutting edge is provided on the lower, inner surface of the first cutting blade. In another embodiment, in an arrow with a shaft, a reversible cutting apparatus includes a first cutting blade with a connection receiver space for connection with an arrow shaft such that the first cutting blade extends outwardly from the arrow shaft and where the first cutting blade includes a first cutting edge and a second cutting edge. A second cutting blade is provided with a connection receiver space for connection with the arrow shaft such that the second cutting blade extends outwardly from the arrow shaft and where the second cutting blade extends outwardly from the arrow shaft but on a separate plane than the first cutting blade such that the first cutting blade and the second cutting blade are offset from each other when connected with the arrow shaft.

BACKGROUND OF THE INVENTION

Applicant has studied the art and science of bows and arrows and the difficulty of using both in target shooting and hunting game. As a result of Applicant's research and investigation, Applicant has obtained a patent for a Wire Broadhead Apparatus and Method, U.S. Pat. No. 7,311,622 and for a Broadhead Blade Air Flow Equalizer Apparatus and Method, U.S. Pat. No. 7,393,295 and has a co-pending application for a Continuation In Part of that patent. Still, there is room for improvement in the art in various areas. By way of example only and not by limitation, Applicant has observed that prior art arrows that include removable blades are difficult to attach and dangerous to carry once attached. Further, prior art arrows include evenly spaced blades or blade cutting edges. Applicant has determined that these prior art blades by design ensure that the blades and the blade cutting edges often impact the target at essentially the same time. This is a potential problem in that kinetic energy is transferred through all the contact edges at the same time over the wide cutting widths of these blades thus resulting in a less than deadly transfer of energy and a potentially non-lethal strike. Additionally, Applicant has found that prior art cutting blades have trended toward very thin blades and cutting edges. This creates two problems, a tendency of these thin, thus fragile, blades to break and the creation of a strong aerodynamic lift as the thin, flat blades speed through the air. Additionally, once a prior art cutting edge is damaged or dulled, there is no easy way to renew it without time consuming and costly sharpening or total replacement.

Thus, there is a need in the art for a cutting blade for arrows that is easy to assemble, safe to transport, and durable and that does not create excessive drag. It, therefore, is an object of the invention to provide a cutting blade that is easy to use, easy to place in a safe transport position and yet may be quickly placed in "firing position", that is strong and durable, that is not as susceptible to lift and which is reversible when a fresh cutting edge is desired.

SUMMARY OF THE INVENTION

Accordingly, the reversible cutting apparatus of the present invention, according to one embodiment includes a first cutting blade for connection with an arrow shaft such that the first cutting blade extends outwardly from the arrow shaft. The first cutting blade includes an upper, outer surface and a lower, inner surface. A first cutting edge is provided on the upper, outer surface of the first cutting blade and a second cutting edge is provided on the lower, inner surface of the first cutting blade.

As used herein the terms "cutting blade" and "cutting edge" are used to distinguish between the support for the cutting edge (the cutting blade) and the part of the cutting blade that makes initial contact with a target (the cutting edge). The two items may be made of a single material of uniform dimensions, such as a rectangular piece of metal, such that the corner of the rectangle serves as the cutting edge, for example only and not by way of limitation. Or the cutting edge may be distinguished by having a sharp, reduced dimension as compared to the cutting blade.

Further, the terms "upper", "outer", "inner" and "lower" have their common meaning as more clearly understood with reference to the accompanying figures and description. In general, however, for a blade that extends essentially perpendicular to an arrow shaft, the "upper" surface is the surface on the leading surface of the cutting blade in the direction of the front of the arrow shaft and the arrow point, if there is one. Conversely, the "lower" surface in such an orientation is the trailing surface. In orientations of a blade and an arrow shaft in which a blade angles away from connection with the arrow shaft at or near the arrow point so as to create some variety of a swept back "V" shape, the "outer" surface is the surface on the outside of the blade and farthest away from the arrow shaft. Conversely, in such an orientation, the "inner" surface is the surface of the cutting blade on the inside of the blade and closest to the arrow shaft.

In another aspect of the invention, the first cutting edge and the second cutting edge are approximately parallel to the arrow shaft. In another aspect, the first cutting blade includes at least one cutting edge that is offset from a center line of the first cutting blade. In one aspect, the second cutting edge is approximately opposite from the first cutting edge.

In another aspect, a second cutting blade is provided for connection with the arrow shaft such that the second cutting blade extends outwardly from the arrow shaft but on a separate plane than the first cutting blade such that the first cutting blade and the second cutting blade are offset from each other when connected with the arrow shaft. In a further aspect of this invention, the first cutting blade and the second cutting blade include a shaft connection receiver space. In one aspect, the first cutting blade and the second cutting blade include a shaft connection recess and the shaft connection recess of one cutting blade fits within the shaft connection recess of the other cutting blade. In a further aspect, the first cutting blade and the second cutting blade include a shaft connection recess and a shaft connection receiver space such that the first and second cutting blades are rotatable around the shaft connection receiver space and the shaft connection recess of one cutting blade fits within the shaft connection recess of the other cutting blade. In another aspect, the second cutting blade includes a cutting edge that is approximately parallel to the arrow shaft.

According to another embodiment of the invention, in an arrow with a shaft, a reversible cutting apparatus includes a first cutting blade with a connection receiver space for connection with an arrow shaft such that the first cutting blade extends outwardly from the arrow shaft and where the first cutting blade includes a first cutting edge and a second cutting edge. A second cutting blade is provided with a connection receiver space for connection with the arrow shaft such that the second cutting blade extends outwardly from the arrow shaft and where the second cutting blade extends outwardly from the arrow shaft but on a separate plane than the first cutting blade such that the first cutting blade and the second cutting blade are offset from each other when connected with the arrow shaft.

In another aspect of this invention, the first cutting blade and the second cutting blade are quadrilateral forms. In another aspect, the first cutting blade and the second cutting blade are quadrilateral forms with a leading cutting edge and an approximately oppositely positioned trailing cutting edge. In another aspect, the first cutting blade and the second cutting blade include a cutting edge that is approximately parallel to the arrow shaft. In one aspect, the first cutting blade and the second cutting blade include a cutting edge that is offset from a center line of the first and second cutting blades. In another aspect, the first and second cutting blades are rotatable around the arrow shaft within the connection receiver space when connected with the arrow shaft and where the first and second cutting blades include a shaft connection recess and the shaft connection recess of one cutting blade fits within the shaft connection recess of the other cutting blade. In a further aspect, the first cutting blade and the second cutting blade are approximately perpendicular to the arrow shaft.

According to another embodiment, a reversible cutting method includes the steps of: providing a first cutting blade for connection with an arrow shaft such that the first cutting blade extends outwardly from the arrow shaft, where the first cutting blade includes an upper, outer surface and a lower, inner surface and where the first cutting blade includes a first cutting edge on the upper, outer surface and a second cutting edge on the lower, inner surface; and connecting the first cutting blade with the arrow shaft.

Another aspect of the method includes providing a second cutting blade for connection with the arrow shaft and connecting the second cutting blade with the arrow shaft such that the second cutting blade extends outwardly from the arrow shaft on a separate plane than the first cutting blade such that the first cutting blade and the second cutting blade are offset from each other. In a further aspect, the first cutting blade and the second cutting blade extend outwardly from the arrow shaft and include a cutting edge that is offset from a center line of the first and second cutting blades. In another aspect, the method includes the step of reversing the first cutting blade such that the lower inner surface and the upper outer surface are reversed in position on the arrow shaft.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
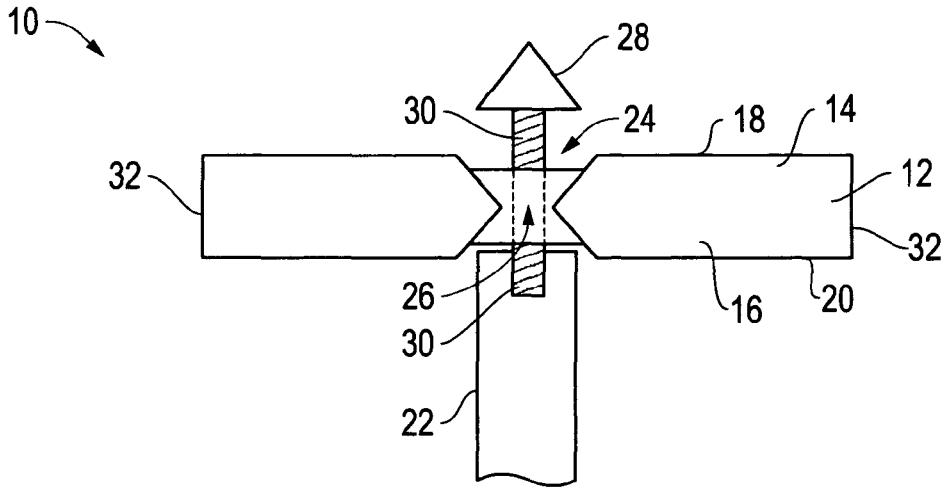
FIG. 1 is a side view of a reversible cutting blade according to one embodiment of the present invention connected with an arrow shaft.
Figure 2:
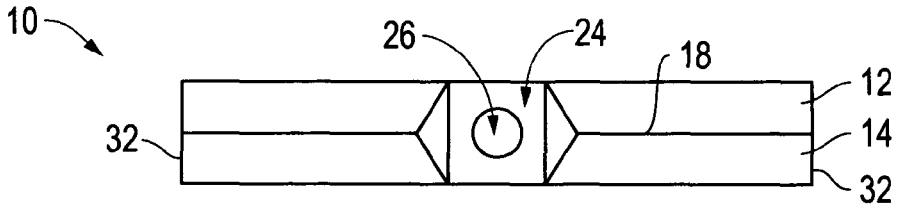
FIG. 2 is a top view of the cutting blade of FIG. 1.

The preferred embodiment of the present invention is illustrated by way of example in FIGS. 1-4. With specific reference to FIGS. 1 and 2, a reversible cutting blade apparatus 10 includes a first cutting blade 12. First cutting blade 12 includes an upper, outer surface 14 and a lower, inner surface 16. A first cutting edge 18 is created on upper, outer surface 14 and a second cutting edge 20 is created on lower, inner surface 16. Reversible cutting blade apparatus 10 is conformed to be connected with arrow shaft 22. According to one embodiment, reversible cutting blade apparatus 10 includes a shaft connection recess 24 and a shaft connection receiver space 26. As illustrated in FIGS. 1 and 2, shaft connection recess 24 is a space created in first cutting blade 12 as will be more particularly disclosed with reference to FIG. 3. Still, FIG. 1 shows that arrow point 28, with arrow point screw thread 30, may fit at least partially within shaft connection recess 24. Likewise, shaft connection receiver space 26 may be a hole through which arrow point screw thread 30 passes. In this manner, attaching first cutting blade 12 to arrow shaft 22 simply requires the user to pass arrow point screw thread 30 through shaft connection receiver space 26 and into arrow shaft 22 and tighten arrow point screw thread 30. Any means and manner of connecting first cutting blade 12 with arrow shaft 22 now known or hereafter developed is suitable for purposes of the invention.

By way of further explanation, first cutting blade 12 is, as illustrated, a four sided, wedge shape blade. The cutting edges of such a cutting blade are integrally formed by the connecting sides of the form. Thus, no additional processing is required to form the cutting edge of such a form, which Applicant has determined is a great cost advantage. Obviously, cutting edges may be further sharpened if desired or formed in other locations as will be discussed more fully with regard to FIGS. 4A and 4B. Additionally, the ends 32 of first cutting blade 12 are shown as perpendicular to the cutting edges 18 and 20. This too provides for cost saving ease of manufacture. Again, though, ends 32 may be formed in any desired shape as deemed useful by the user.

Applicant has determined that the wedge shape, as illustrated, provides a significant cutting edge 18, and 20, that is much more durable than the prior art thin blades and that at the same time is very much more resistant to the air flow forces of lift. The form thus provides an economical cutting blade that is easy to use, easy to attach and, importantly, is reversible. That is, referring to FIG. 1, when first cutting edge 18 becomes dull or damaged the user of Applicant's reversible cutting blade apparatus 10 simply removes first cutting blade 12 from arrow shaft 22 and reverses the first cutting blade 12 such that second cutting edge 20 is now the leading edge of the cutting blade. That is, the user simply rotates the cutting blade to present the second cutting edge 20 as the first edge and reattaches the cutting blade to the arrow shaft. This process is simple, quick and inexpensive. In fact, by way of Applicant's invention a user gets two cutting blades in one.

Figure 3:
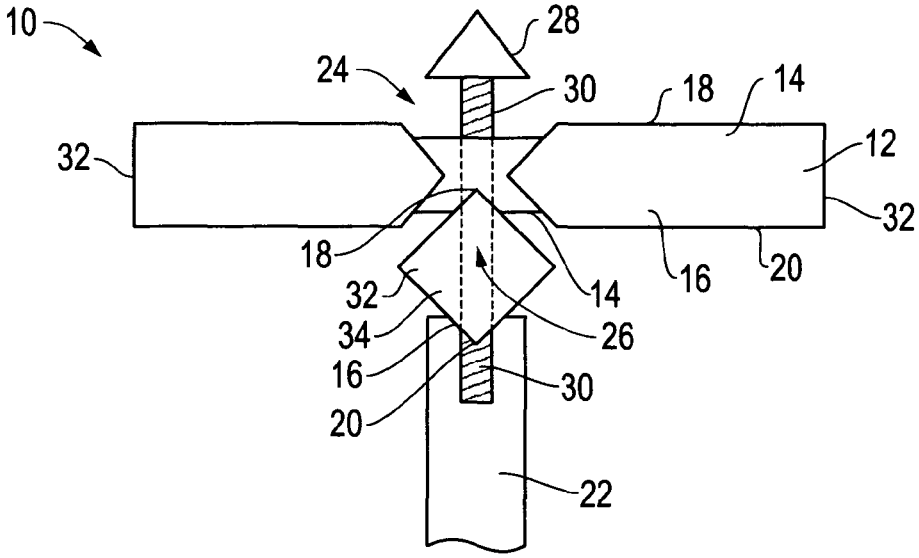
FIG. 3 is a side view of a first cutting blade connected with a second cutting blade; and an arrow shaft.

Referring now to FIG. 3 another embodiment of Applicant's reversible cutting apparatus 10 is illustrated in which a second cutting blade 34 is provided. Preferably, second cutting blade 34 is the same as, but need not be identical to, first cutting blade 12 and includes an upper outer surface 14, lower, inner surface 16, first cutting edge 18 and second cutting edge 20. Further, second cutting blade 34 may include shaft connection recess 24 and shaft connection receiver space 26. As such, FIG. 3 illustrates an embodiment of the invention in which when both first cutting blade 12 and second cutting blade 34 are connected with arrow shaft 22, the blades are connected with arrow shaft 22 on different planes, one above the other. Applicant has determined that this provides insurance against the upper, outer edges 14 of first cutting blade 12 and second cutting blade 34 coming in contact with a target at the same time. When this occurs with prior art blades that include cutting blades on the same plane, the crucial required transfer of kinetic energy is greatly reduced.

Still referring to FIG. 3, it can be seen that the shaft connection recess 24 of first cutting blade 12 fits within the shaft connection recess 24 of second cutting blade 34. When tightened in place on arrow shaft 22 then, first cutting blade 12 is held tightly connected with second cutting blade 34. Importantly, when a user desires to transport this system safely, all that is required is that the connection is loosened. The first cutting blade 12 and second cutting blade 34 may then be rotated so as to align with each other. When secured in alignment with each other, the cutting blades may be easily covered for safe transport. Once on location for shooting, the blades are loosened, positioned as shown in FIG. 3 and tightened in place. Certainly, it is well within the scope of the invention for third, fourth or more cutting blades (not shown) to be provided.

Figure 4A:
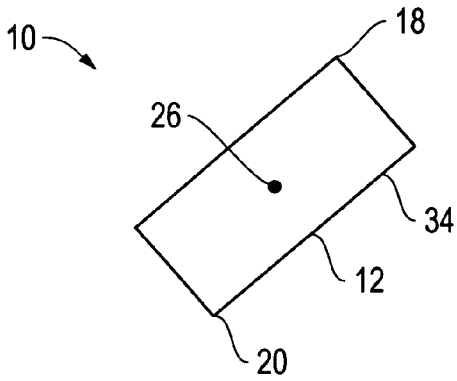
FIG. 4A is an end view of another embodiment of the cutting blade with an offset cutting edge and FIG. 4B is an end view of another embodiment of the cutting blade with curved sides.
Figure 4B:
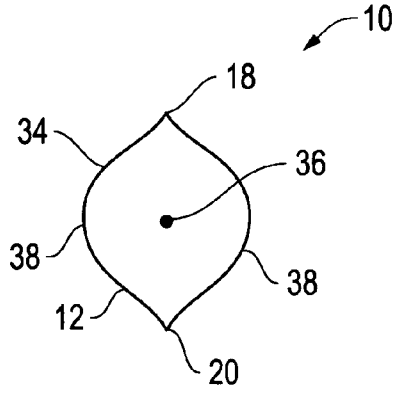

Referring now to FIGS. 4A and 4B, FIG. 4A illustrates another aspect of the invention in which the first or second cutting blades 12 or 34 include blades with a centerline 36 and at least one cutting edge 18 or 20 that is offset from centerline 36. Applicant has determined that this feature enables a user to more closely align two cutting blades for safe travel, all as discussed more fully above. The additional benefit of the two, or more, separate blades being offset is that they can be rotated upon loosening, as described above, into a safe and easy to transport position. Then when the hunt begins, a simple movement to the correct position and tightening on the arrow shaft provides a quick way to be ready to hunt and no special tools are necessary.

FIG. 4B illustrates that cutting blades 12 or 34 of the present invention may be in a form that includes non linear or curved sides 38. Applicant has determined that such a form is even less susceptible to lift forces but may require some machining to create cutting edges 18 and 20.

Figure 5:
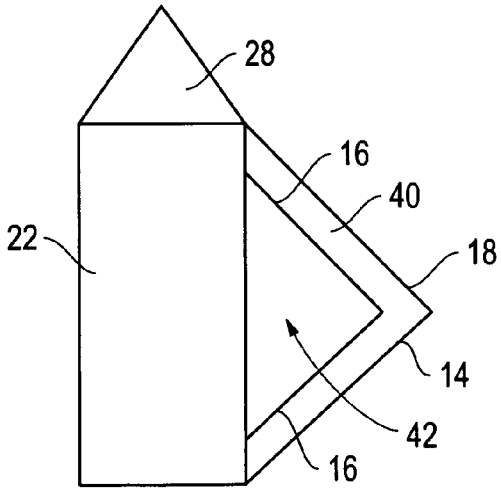
FIG. 5 (Prior Art)
FIG. 5 is a partial side view of a Prior Art swept back cutting blade.

Referring now to FIG. 5, for purposes of continued explanation, prior art arrow shaft 22 includes an arrow point 28 and a cutting blade 40. Cutting blades 40 of the prior art often are of the form illustrated where they are connected with arrow shaft 22 at or near arrow point 28 and then form a "V" shaped swept back wing form with an upper, outer surface 14 and a first cutting edge 18. This form may take many shapes and may even reverse itself and reconnect with arrow shaft 22 below arrow point 28 as shown. These prior art blades 40 may even include cut away space 42 to reduce weight and so forth. As such the inside edge of cut away space 42 represents the lower, inner surface 16 of cutting blade 40. It should be clearly understood now that prior art cutting blade 40 does not include a second cutting edge 20 on lower inner surface 16 of cutting blade 40 and is most definitely not reversible as described above. That is, even if the cutting blade were removed, reversed and reattached to arrow shaft 22, no new cutting edge is provided. Only the same upper, outer surface 14 and first cutting edge 18 is ever presented in the prior art.

By way of further explanation, the reversible cutting apparatus of the present invention is directed to a reversible, preferably wedge shaped, cutting blade with cutting edges on two surfaces. The reversible blade is a significant improvement in the art by itself. The wedge form as illustrated, however, provides convenient cutting edges at the intersection of the quadrilateral form. Applicant has determined that this form also creates less lift than the prior art forms and is stronger and thus more durable. Importantly, by way of Applicant's invention the cutting blade is reversible and when used in combination with another similar cutting blade, rotatable and alignable for safe transport. Additionally, when two cutting blades are provided as described above and illustrated the cutting edges are prevented from simultaneous contact with a target thus preventing a detrimental loss of kinetic energy.

Aerodynamically speaking, Applicant has noted as significant the accuracy obtained from stretching a typical prior art blade from a "flat", "one edged" razor blade to a much less flat blade as disclosed herein. The much less flat shape allows aerodynamic efficiency which allowed Applicant to shoot an arrow with a wide cutting width four bladed configuration with three different sized blades and yet still maintain the same point of impact. That is, the Applicant has determined that the present invention allowed lowered frontal pressures in comparison to prior art systems, including his own which eliminated additional drag forces at the rear of the arrow, and provided longer, flatter trajectory. This was found true even when compared to standard big game animal hunting broadheads with lesser cutting widths. Applicant's invention achieves much greater maintenance of the same impact point as the field point than the other less significant cutting width prior art broadheads. This is a significant accomplishment previously considered impossible to accomplish.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A reversible cutting apparatus comprising:

a. a first cutting blade for connection with an arrow shaft such that the first cutting blade extends outwardly from said arrow shaft wherein said first cutting blade includes an upper, outer surface and a lower, inner surface;

b. a first cutting edge on said upper, outer surface of said first cutting blade; and c. a second cutting edge on said lower, inner surface of said first cutting blade.

2. The apparatus of claim 1 wherein said first cutting edge and said second cutting edge are approximately perpendicular to said arrow shaft.

3. The apparatus of claim 1 wherein said first cutting blade includes at least one cutting edge that is offset from a center line of said first cutting blade.

4. The apparatus of claim 1 wherein said second cutting edge is approximately opposite from said first cutting edge.

5. The apparatus of claim 1 further comprising a second cutting blade for connection with said arrow shaft such that said second cutting blade extends outwardly from said arrow shaft but on a separate plane than said first cutting blade such that said first cutting blade and said second cutting blade are offset from each other when connected with said arrow shaft.

6. The apparatus of claim 5 wherein said first cutting blade and said second cutting blade include a shaft connection receiver space.

7. The apparatus of claim 5 wherein said first cutting blade and said second cutting blade include a shaft connection recess and said shaft connection recess of one cutting blade fits within said shaft connection recess of the other cutting blade.

8. The apparatus of claim 5 wherein said first cutting blade and said second cutting blade include a shaft connection recess and a shaft connection receiver space such that said first and second cutting blades are rotatable around said shaft connection receiver space and said shaft connection recess of one cutting blade fits within said shaft connection recess of the other cutting blade.

9. The apparatus of claim 5 wherein said second cutting blade includes a cutting edge that is approximately perpendicular to said arrow shaft.

10. In an arrow with a shaft, a reversible cutting apparatus comprising:

a. a first cutting blade with a connection receiver space for connection with an arrow shaft such that the first cutting blade extends outwardly from said arrow shaft and wherein the first cutting blade includes a first cutting edge and a second cutting edge; and b. a second cutting blade with a connection receiver space for connection with said arrow shaft such that the second cutting blade extends outwardly from said arrow shaft and wherein said second cutting blade extends outwardly from said arrow shaft but on a separate plane than said first cutting blade such that said first cutting blade and said second cutting blade are offset from each other when connected with said arrow shaft.

11. The apparatus of claim 10 wherein said first cutting blade and said second cutting blade are quadrilateral forms.

12. The apparatus of claim 10 wherein said first cutting blade and said second cutting blade are quadrilateral forms with a leading cutting edge and an approximately oppositely positioned trailing cutting edge.

13. The apparatus of claim 10 wherein said first cutting blade and said second cutting blade include a cutting edge that is approximately parallel to said arrow shaft.

14. The apparatus of claim 10 wherein said first cutting blade and said second cutting blade include a cutting edge that is offset from a center line of said first and second cutting blades.

15. The apparatus of claim 10 wherein said first and second cutting blades are rotatable around said arrow shaft within said connection receiver space when connected with said arrow shaft and wherein said first and second cutting blades include a shaft connection recess and said shaft connection recess of one cutting blade fits within said shaft connection recess of the other cutting blade.

16. The apparatus of claim 10 wherein said first cutting blade and said second cutting blade are approximately perpendicular to said arrow shaft.

17. A reversible cutting method comprising:

a. providing a first cutting blade for connection with an arrow shaft such that the first cutting blade extends outwardly from said arrow shaft, wherein said first cutting blade includes an upper, outer surface and a lower, inner surface and wherein the first cutting blade includes a first cutting edge on said upper, outer surface and a second cutting edge on said lower, inner surface; and b. connecting said first cutting blade with said arrow shaft.

18. The method of claim 17 further including providing a second cutting blade for connection with said arrow shaft and connecting said second cutting blade with said arrow shaft such that said second cutting blade extends outwardly from said arrow shaft on a separate plane than said first cutting blade such that said first cutting blade and said second cutting blade are offset from each other.

19. The method of claim 18 wherein said first cutting blade and said second cutting blade extend outwardly from said arrow shaft and include a cutting edge that is offset from a center line of said first and second cutting blades.

20. The method of claim 17 further including reversing said first cutting blade such that said lower inner surface and said upper outer surface are reversed in position on said arrow shaft.

* * * * *